US005687806A

United States Patent [19]

Sallwasser et al.

[11] Patent Number: 5,687,806

[45] Date of Patent: Nov. 18, 1997

[54] METHOD AND APPARATUS FOR DRILLING WITH A FLEXIBLE SHAFT WHILE USING HYDRAULIC ASSISTANCE

[75] Inventors: Alan Sallwasser, Houston; Kenneth Havlinek, Missouri City; Thomas D. MacDougall, Sugar Land; Miles Jaroska, Richmond; Duane LaDue, Sugar Land; Wayne A. Tyler, Pearland; Mario Flores, Houston; Mark L. Hinton, Sugar Land; Thomas D. Svoboda, Pasadena; Michele Tesciuba, Houston, all of Tex.

[73] Assignee: Gas Research Institute, Chicago, Ill.

[21] Appl. No.: 603,307

[22] Filed: Feb. 20, 1996

[51] Int. Cl.[6] ..... E21B 4/16; E21B 7/08; E21B 17/20

[52] U.S. Cl. ..... 175/62; 175/78; 175/81

[58] Field of Search ..... 166/55, 55.1, 55.7, 166/55.8; 175/61, 62, 77, 78, 81, 94, 95

[56] References Cited

U.S. PATENT DOCUMENTS

| | | | |
|---|---|---|---|
| 2,516,421 | 7/1950 | Robertson | 175/78 |
| 4,062,412 | 12/1977 | McIlvanie | 175/78 X |
| 4,658,916 | 4/1987 | Bond | 175/81 |
| 5,195,588 | 3/1993 | Dave | 166/264 |

FOREIGN PATENT DOCUMENTS

| | | | |
|---|---|---|---|
| 1615353 | 12/1990 | U.S.S.R. | 175/77 |

OTHER PUBLICATIONS

"Longer–Than–Seam–Height Drill Development Program", Derby et al, United States Department of the Interior Bureau of Mines, 1978.

*Primary Examiner*—David J. Bagnell

*Attorney, Agent, or Firm*—Brigitte L. Jeffery; John J. Ryberg

[57] ABSTRACT

An apparatus and method are disclosed for applying thrust (weight on bit) to a drill bit when drilling with a flexible drilling shaft while creating perforations in a cased well. The thrust is applied directly to the drill bit instead of applying it to the drill bit through the flexible drilling shaft. A support bracket is also in contact with a piston and is in slidable contact with the tool housing. A portion of the piston is positioned inside a chamber in the housing and is slidably attached to the chamber walls. As hydraulic fluid flows into the chamber opposite the piston, the piston is forced toward the drill bit. As the piston moves toward the drill bit, force is exerted on the support bracket which causes the bracket to move toward the drill bit. This force is transferred to the drill bit during the drilling process, thereby supplying the force (weight on bit) needed by the drill bit to effectively drill through a desired material.

18 Claims, 4 Drawing Sheets

METHOD AND APPARATUS FOR DRILLING WITH A FLEXIBLE SHAFT WHILE USING HYDRAULIC ASSISTANCE

FIELD OF THE INVENTION

This invention relates to the field of investigating earth formations surrounding a borehole using a flexible shaft to drill perforations through a borehole wall and into the earth formation. More particularly, this invention relates to the application of force to the drill bit by means other than through the flexible drilling shaft in order to increase shaft life.

BACKGROUND OF THE INVENTION

The use of a flexible shaft in drilling operations has been done for years. A number of drilling systems have been proposed where the drilling bit is driven by a flexible shaft. One such system that can be implemented in oil and gas production is described in U.S. Pat. No. 4,658,916 (Bond). This patent utilizes a flexible drill shaft that is operable primarily from the vertical borehole when drilling in the formation in a direction that is along a generally horizontal path for a significant distance of lateral drilling away from the borehole thereby to enlarge formation contact area.

Generally, the motivation for using a flexible shaft is to overcome space limitations on the drilling equipment. A flexible drilling shaft will enable the drilling of a hole which is deeper than the headroom available above the hole to be drilled. For example, in the coal mining industry, roof bolt holes are drilled into the ceiling of coal seams to a depth which can reach three times the height of the coal seam itself. In oil and gas wells it is often necessary to drill holes perpendicular to the borehole wall which are deeper than the internal diameter of the borehole. This need also applies in cased wells. In these situations, to drill such holes requires a system where a flexible drilling shaft is fed around a bend into the hole as the drilling progresses. It is important to note that the available space in these cased wells is far smaller than in previous flexible drilling shaft applications. Rather than 3 feet of height in coal mines, inner diameters of cased wells tend to be five inches or less. Thus the drilling mechanism, and the flexible shaft, must be much smaller in scale.

For cased well applications, a flexible shaft, with fittings at both ends, is operated in a tubing of fixed curvature. The fittings are used to permit easy connection of the shaft to another assembly, such as the drive motor shaft and the drill bit. To facilitate drilling, the drill bit not only must be torqued so that it rotates about it's central axis (measured in "revolutions per minute" or "RPM"), but also it must be thrusted against the material to be drilled. This thrust is referred to as "weight-on-bit" or "WOB". In a drilling system that uses a flexible drilling shaft, both of these forces are typically applied to the bit through the flexshaft. An analysis of a flexible shaft in operation would yield an aggregate force balance of torques, moments and axial forces, each which would produce a deformation of the shaft.

During drilling of the steel casing, it has been found that the shafts experience large axial compressive forces. These forces tend to induce helixing and shorten the effective length of the shafts. Also, due to the high stress, the shaft life will be shortened. It is desirable to have a long shaft life not only for system reliability, but also to increase the allowable number of drilled holes before one must retrieve the mechanism from the well and replace the worn shaft. Thus, it is important to minimize, or eliminate, the stress elements within the shaft.

Another problem that has been recognized with such systems is the dulling of the drill bit. After perforating the steel casing, the flexible shaft must continue applying torque and thrust, albeit at lower values, while the drill bit cuts through several inches of cement. Then, in many cases, it is desirable to continue drilling into the rock, which is typically shale, limestone, or sandstone. A common component of many of these formations is quartz, a crystalline substance that is much harder than any cutting edge of typical drill bits (except for diamond, which cannot be used as it cannot drill through steel). These quartz particles dull the bit enough so that it requires higher values of torque and WOB in order to continue drilling.

Though these increased values do not pose a problem in the cement or rock (as the initial torque and thrust were very low), they do while trying to drill steel in subsequent perforations. As previously noted, the high thrust required in order to successfully drill steel greatly shortens the life of the shaft. Once the bit dulls, the required thrust gets even larger. It has been found that after drilling only a couple of inches into sandstone, the bit is too dull to start another perforation while being driven by a flexible shaft. If one attempts to generate the required thrust, the flexible shaft is often destroyed.

This problem can be mitigated if the thrust required of the drill bit is supplied to the flexible shaft just before it enters the drilled hole, rather than at the tail of the flexshaft as is the usual case. A number of thruster/torque systems have been developed and discussed in the literature (G. K. Derby and J. E. Bevan, "Longer than Seam Height Development Program", U.S. Department of the Interior, Bureau of Mines, 1978, U.S. Department of Interior Library). These described systems, however, are complicated and often suffer from reliability problems.

Furthermore, it has been found that for this particular application of drilling (through metal casing, cement, and then formation rock) a system which supplies thrust to the drill only while it is cutting the casing is sufficient to greatly increase the life of the shaft. Even with a dull bit, it has been found that the increased torque and thrust while drilling cement and rock do not greatly reduce shaft life.

Thus, there remains the need for a system in which high forces can be applied to a drill bit during drilling operations without damaging the flexible shaft.

SUMMARY OF THE INVENTION

It is an object of this invention to increase the life of the flexible drilling shaft.

It is another object of the invention to reduce the stress on the shaft during drilling.

It is another object of the invention to use a means to apply thrust to the drill other than applying the thrust at the tail of the flexible shaft.

The present inventions extends the life of a flexible shaft used for drilling in an earth formation by applying the thrust (WOB) for drilling to the drill bit at a point just as the drill bit contacts the borehole wall or casing. The thrust is supplied to the drill bit by a hydraulic piston system. The drill bit and connected flexible shaft are in contact with a bearing, which is held in a bracket or other suitable means. The bracket is in contact with a piston. During the drilling process, the piston moves toward the borehole wall thereby generating thrust that is translated through the bracket to the bearing and drill bit. Force from the piston is applied to the drill bit as the bit drills into the steel. This technique will apply force directly to the drill bit, unlike prior methods that apply force to the drill bit through the flexible shaft. Note that the torque is still applied via the flexible shaft.

This invention is particularly designed to increase shaft life by reducing the peak stress. This peak occurs in the drilling of the steel casing. This is done by providing in the piston system a piston stroke such that force from the piston is applied to the drill bit only while drilling through steel casing. After drilling through the steel casing, the piston (and bracket and bearing) are retracted and thrust is supplied to the drill bit via the flexshaft for the remainder of the drilling operation.

The system of the present invention is simple, robust, and can be built into the small diameter tool package capable of passing into the internal diameter of the casing. It constitutes a great improvement over flexible shaft drilling whereby both thrust and torque are always applied from the tail of the flexshaft. It also overcomes the practical difficulties of thruster/torque systems.

DETAILED DESCRIPTION OF THE PREFERRED EMBODIMENT

Figure 1:
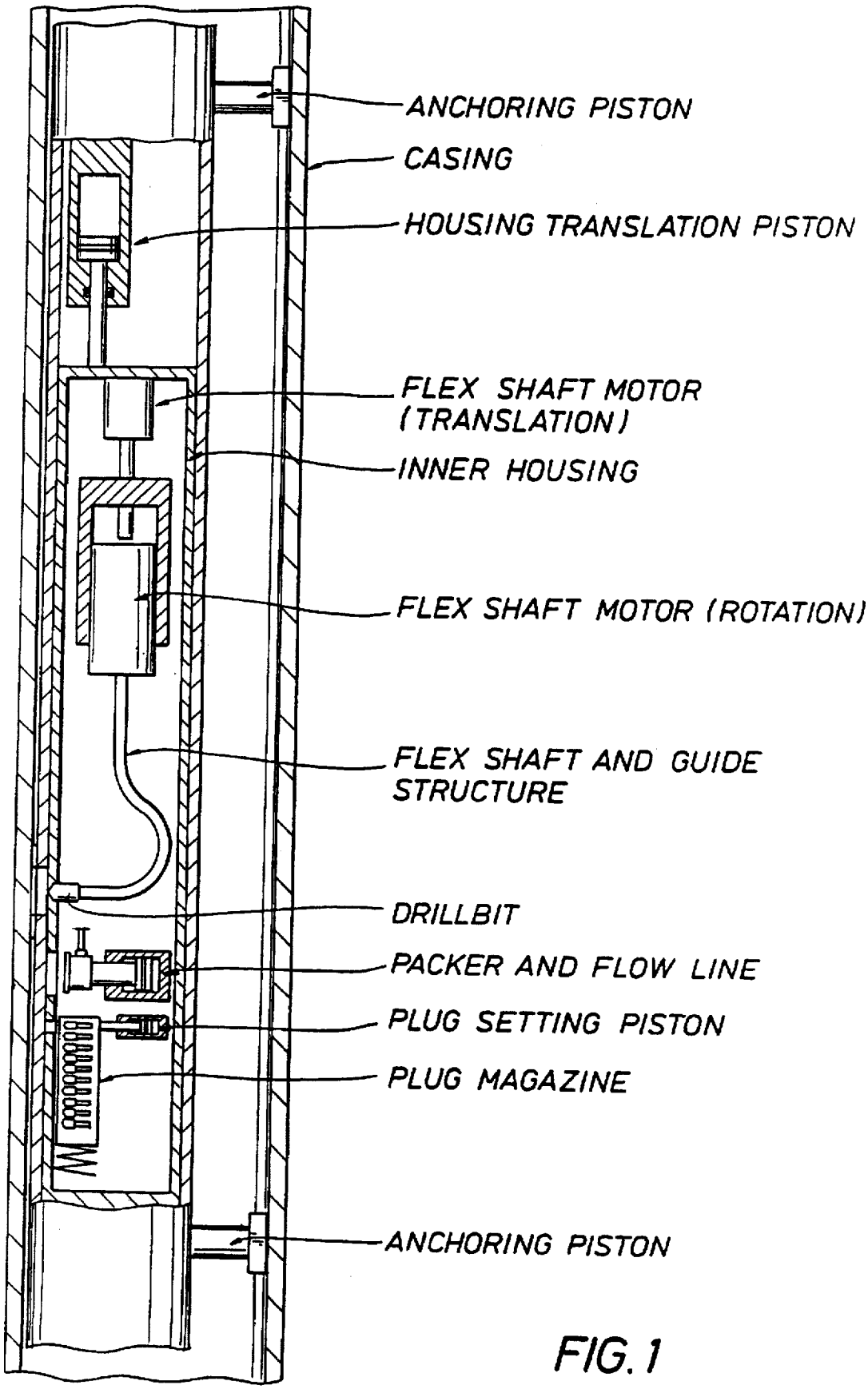
FIG. 1 is a schematic of a formation testing apparatus that is used in a cased borehole environment.
Figure 2:
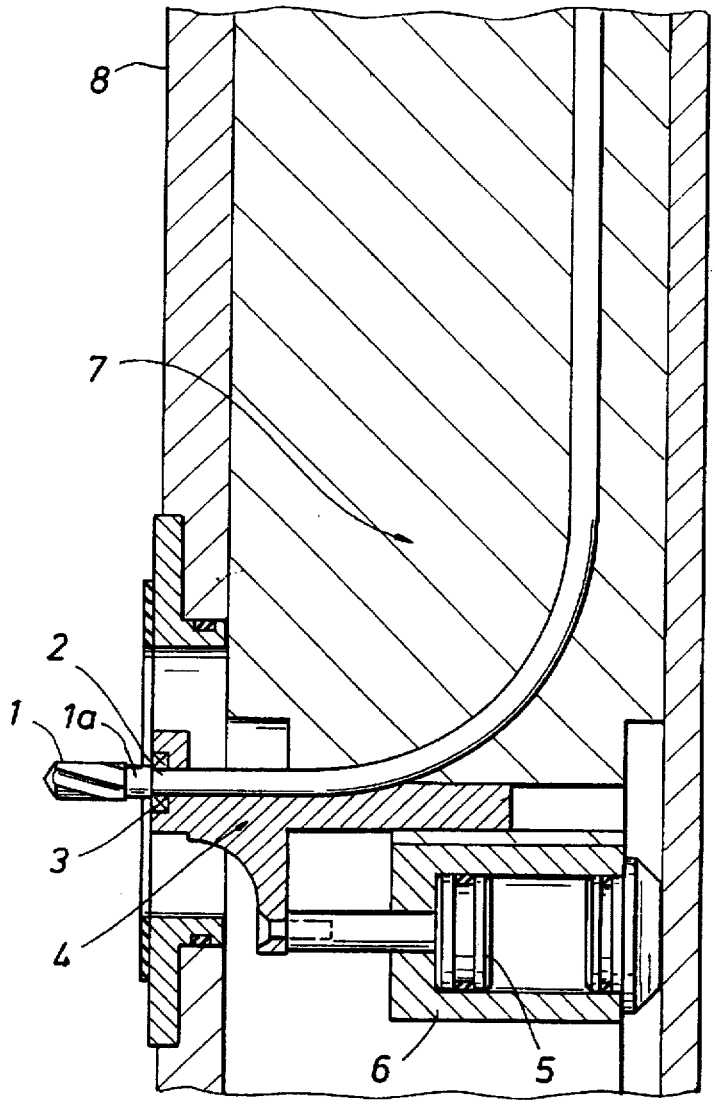
FIG. 2 is a schematic, longitudinal section single piston diagram of an apparatus in accordance with the present invention, which can be used to practice the method of the invention.

FIG. 1 shows the present invention in the context of a downhole formation tester that perforates a cased borehole, takes a formation sample and reseals the borehole casing. This cased hole tester is described in U.S. patent application Ser. No. 08/603,306, docket number 20.2634, filed concurrently with the present invention and related to U.S. Pat. No. 5,195,588. The focus of the present invention is on perforating the borehole casing. The present invention is described in the context of drilling through the casing of a borehole. In FIG. 2, a drill bit, 1 is connected to a flexible driveshaft 2. This drill bit has a length somewhat greater than the thickness of the casing to be drilled and a diameter somewhat greater than the diameter of the flexible driveshaft 2. A thrust bearing 3 fits into a support frame 4. This thrust bearing 3 can apply force to the drill bit by pushing on the drill bit shoulder 1*a* formed at the junction between the drill bit and the flexible driveshaft. The thrust bearing enables a piston to apply force to a rotating drill bit without excessive frictional losses. The support frame can be driven up and down along an axis parallel to the axis of drilling shaft by a piston, 5 which is moved by the application of hydraulic pressure through the piston housing 6. The piston chamber length 6*a* must be somewhat greater than the casing thickness so that force can be transmitted to the drill throughout the process of drilling through the entire casing. The flexible drive shaft moves along a guide that has the geometry 7. The guide can be a pair of plates with a groove formed when the plates are together. This guiding geometry directs the flexible shaft from an axis perpendicular to the drilled hole to one parallel to the drilled hole. The guide 7 along with other features of the present invention are contained in an inner housing 8. Driving the drill via a flexible shaft allows drilling a hole to a depth greater than the diameter of the drilling apparatus. A translating drive system which can apply both torque and thrust to the flexible driveshaft which is needed and shown in FIG. 1.

Figure 3:
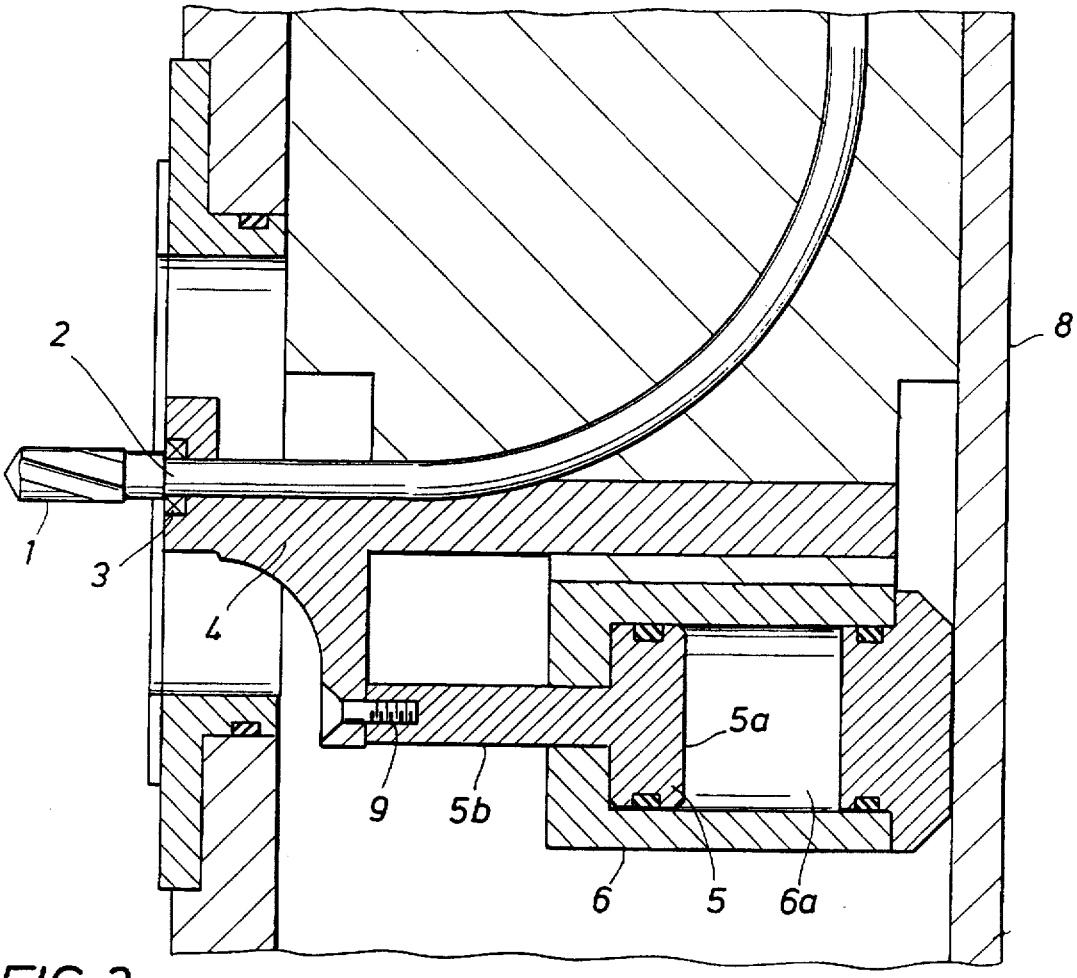
FIG. 3 is a detailed view of the of a single piston embodiment of the present invention.

Referring to FIG. 3, the face 5*a* of the piston is inside the piston housing 6 while the piston arm 5*b* is attached to the support frame 4 by bolt 9. The support frame 4 is slidably attached to the piston housing such that the frame moves with the motion of the piston. Bearings 3 fit into the support frame 4. The bearings are also in contact with the drill bit 1. During the drilling process, hydraulic fluid fills piston chamber 6*a*. As the chamber fills, the fluid forces the piston toward the drill bit and borehole wall. As the piston moves, force is exerted on the support frame which moves in the direction of the piston movement. The force exerted by the piston as it moves forward is translated through the support frame to the bearings 3. The bearings are in contact with the drill bit 1 and exerts that same force onto the drill bit as it drills through the casing. As the drilling through the casing finishes, force from the piston is halted and the piston is retracted back into the tool. To complete the drilling operation, the flexible shaft now provides both the required torque and thrust.

Figure 4:
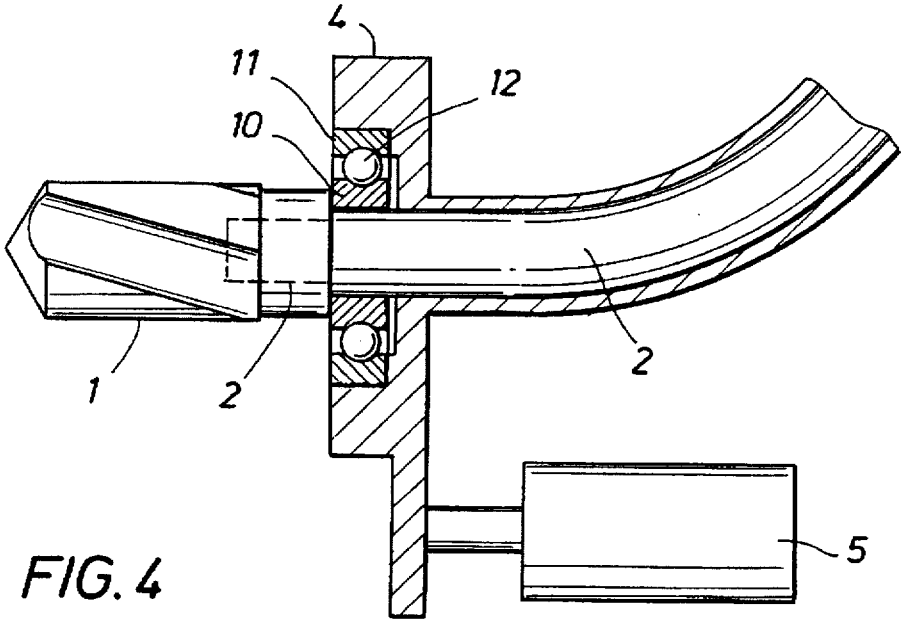
FIG. 4 is a detailed view of the bearing components of the present invention.

A detailed view of the bearings 3 is illustrated in FIG. 4. The bearing 3 has an inner face 10, an outer face 11 and a ball 12. The inner face 10 is in contact with the drill bit. The drill bit has a diameter that is larger than the diameter of the flexible shaft 2. The inner face 10 makes contact with the drill bit in the space resulting from the difference in the drill bit and flexible shaft diameters. The outer face 11 is in contact with the support frame 4. The force from piston 5 is translated from frame 4 through the outer face 11 and ball 12 to the inner face 10 and the drill bit 1.

Figure 5:
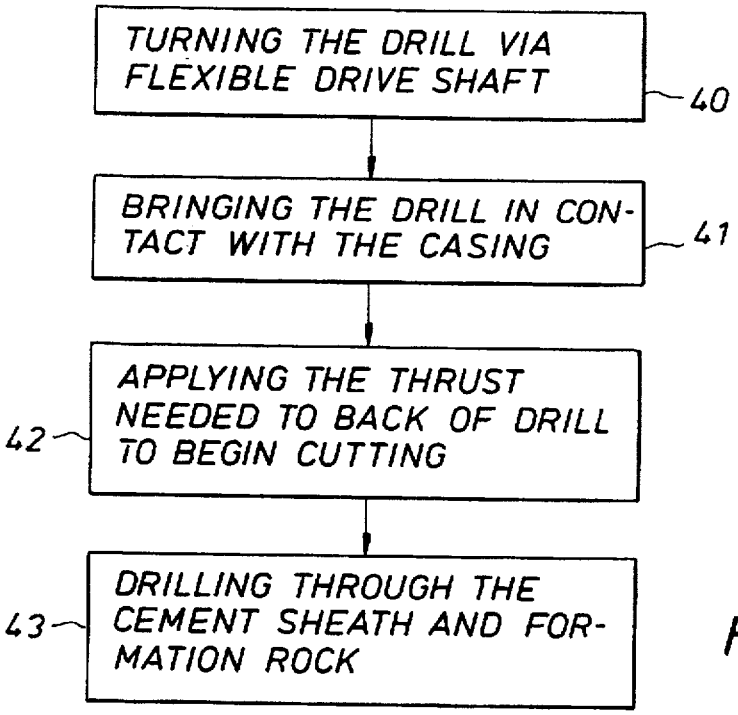
FIG. 5 is a flow diagram of the sequence of the present invention.

A standard drilling sequence is to first drill through steel casing, then a cement sheath, and finally into a formation rock. This sequence is illustrated in FIG. 5 and begins by turning the drill 40, at the normal cutting rotational speed, via the flexible drive shaft from the translating drive system. Next, the spinning drill is brought into contact with the casing 41 by simultaneously moving the translating drive system upward as shown in FIG. 2 and the piston outward toward the right as shown in FIG. 2. After contacting the casing the thrust needed to begin proper cutting is applied to the back of the drill from the piston 42. By applying thrust in this manner, it is not necessary to apply thrust to the drill via the flexible drilling shaft. It is, however, necessary to coordinate movement of the translating drive system so that it moves with the same velocity as the piston. In this way, the flexible drive shaft is keep in a neutral state, neither in tension nor in compression, as drilling through the casing progresses. Next in the sequence, the cement sheath and the formation rock are drilled 43. For these steps both rotation and thrust can be supplied by the translating drive system. Applying thrust through the drive system at this point is practical due to the lower strength of these materials and thus the low combined torsional and compression loads they impose on the flexible drive shaft.

Figure 6:
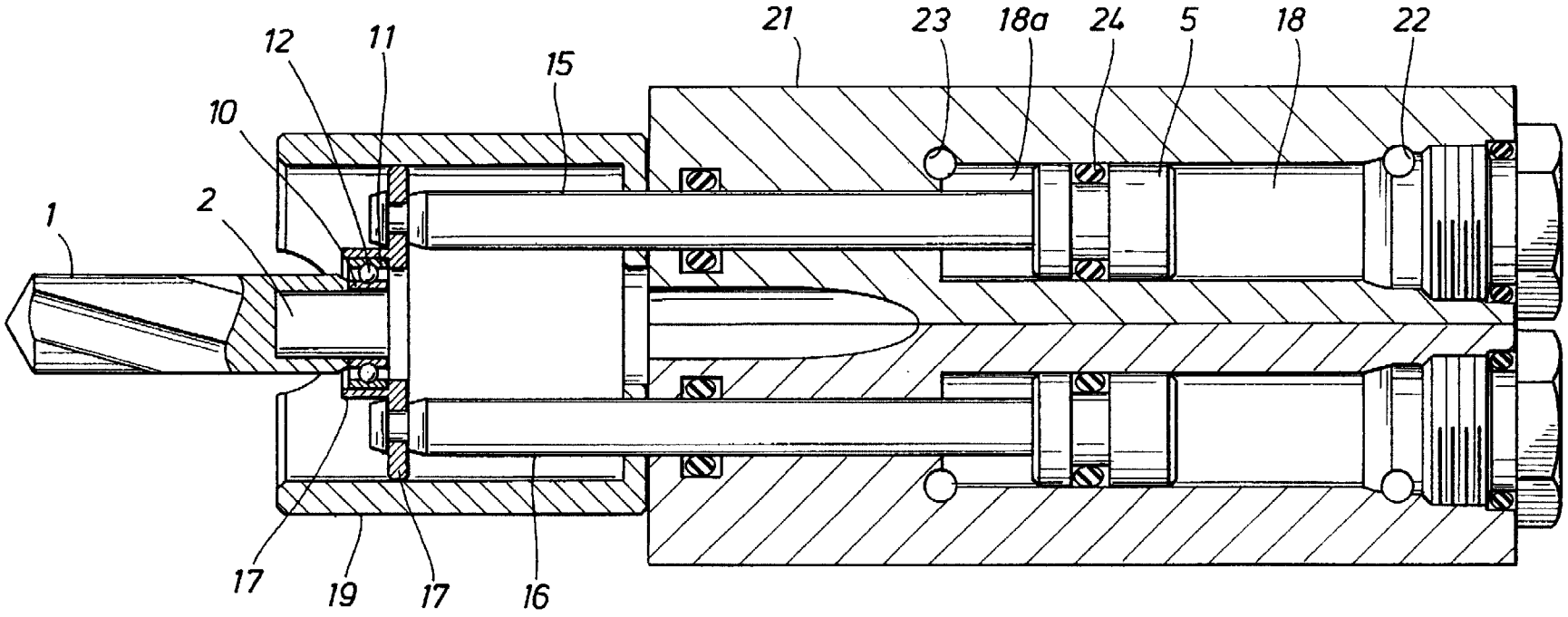
FIG. 6 is a view of the dual piston embodiment of the present invention.

Another embodiment of the present invention shown in FIG. 6 uses dual pistons to supply thrust to the drill bit during the drilling process. This embodiment of the invention has been found to fit better into the present geometric constraints than the previous described embodiment. Piston arms 15 and 16 are positioned on opposite sides of the drill bit 1. The piston arms and piston face 5 move inside a piston housing 21. Inside the housing are chambers 18 and 18*a*. As with the previous embodiment, the drill bit is connected to the flexible shaft 2. The bearings having inner face 10, outer face 11 and ball 12 components transmit the thrust from the pistons via a support bracket 17 to the drill bit. As previously described, the inner face 10 of the bearing is in contact with the drill bit. Notice that the diameter of the drill bit at the point of contact is smaller than the other portion of the drill bit. This diameter reduction provides a contact surface for the inner face 10. The outer face 11 is in direct contact with a support bracket 17. These brackets 17 are also in contact with piston arms 15 and 16. In addition, these brackets are in slidable contact with a support housing 19.

The movement of the piston is controlled by supplying hydraulic power to extend or retract the pistons. During the drilling procedure, hydraulic fluid enters (22) the chambers 18 and the hydraulic cylinders extend. The fluid forces pistons 5 toward the drill bit. As thrust is applied to the piston, the piston moves toward the drill bit forcing the support brackets 17 toward the drill bit. This movement by the support bracket applies thrust to the drill bit during the drilling process. At the completion of the application of the thrust to the drill bit, the piston is retracted by supplying fluid through the cylinder retract 23 into cylinder chambers 18*a*. This technique forces the piston away from the drill bit and forces hydraulic fluid in the cylinder chambers 18 through the cylinder extend 22. Piston seals 24 contain O-rings that prevent fluid from passing between chambers 18 and 18*a*.

The present invention can be adjusted to apply thrust to a drill bit at extended depths in an earth formation by varying the length of the piston stroke or piston chamber as desired. The method and apparatus of the present invention provides a significant advantage over the prior art. The invention has been described in connection with the preferred embodiments. However, the invention is not limited thereto. Changes, variations and modifications to the basic design may be made without departing from the inventive concept in this invention. In addition, these changes, variations modifications would be obvious to those skilled in the art having the benefit of the foregoing teachings contained in this application. All such changes, variations and modifications are intended to be within the scope of the invention which is limited by the following claims.

We claim:

1. A flexible shaft drilling system to be positioned in a borehole traversing an earth formation for drilling through a material adjacent to said formation, comprising:

a) a drill bit to be brought in contact with said material;

b) a flexible shaft connected to said drill bit, said shaft supplies torque to said drill bit;

c) an actuating means connected to said flexible shaft that rotates said flexible shaft and drill bit during the drilling process; and, d) a thruster that supplies force directly to said drill bit to enhance the cutting efficiency of the drill bit through said material and of increasing the length of said flexible shaft reliability, said thruster comprising:

i) piston means for supplying the force to said drill bit;

ii) a bracket connected to said piston means for translating said force to the drill bit; and, iii) bearings positioned between and in contact with said drill bit and said bracket.

2. The drilling system of claim 1 wherein said piston comprises a base and a stem, said stem connected to said bracket and said base being positioned inside a chamber, said piston base being in slidable contact with the walls of said chamber.

3. The drilling system of claim 2 further comprising hydraulic fluid to supply force to said piston base.

4. The drilling system of claim 3 wherein said chamber has an opening through which fluid is received and discharged.

5. The drilling system of claim 2 wherein two chambers are formed by the position of said piston base inside said chamber.

6. The drilling system of claim 5 wherein each chamber has at least one opening through which fluid is received into and discharged from said chamber.

7. The system of claim 6 wherein said fluid is hydraulic.

8. The drilling system of claim 1 wherein said piston means comprises a plurality of pistons.

9. The drilling system of claim 8 wherein each piston comprises a base and a stem, said stem being connected to said bracket and each said base being positioned inside a chamber, a said piston base being in slidable contact with the walls of a said chamber.

10. The drilling system of claim 9 wherein two chambers are formed by the position of said piston base inside a said chamber.

11. The drilling system of claim 10 wherein each chamber has at least one opening through which fluid is received into and discharged from said chamber.

12. A method for drilling through a material adjacent to a formation, using a drill system that includes a drill bit, flexible drilling shaft, and a means for applying force directly to said drill bit, said method comprising the steps of:

a) turning the drill bit with a rotating means via the flexible drilling shaft;

b) bringing the drill bit in contact with the material to be drilled;

c) applying torque to the drill bit using the flexible drilling shaft;

d) applying the force directly to the drill bit using a piston system to begin cutting the material; and, e) drilling through said material with force applied directly to the drill bit.

13. The method of claim 12 further comprising using hydraulic fluid to generate the force applied by said piston to said drill bit.

14. The drilling system of claim 12 wherein said system is suited to drill through a sequence of a strong material and into a less strong material, by supplying force directly to the drill bit when drilling through said strong material and supplying force through the flexible shaft when drilling through said less strong material.

15. A drilling system in a borehole traversing an earth formation for drilling through a material adjacent to said formation, comprising:

a) a means for drilling through said material;

b) an actuating means for rotating said drilling means;

c) a flexible connecting means having two ends, one end connected to said actuating means and the other end connected to said drilling means, for transferring said rotation from the actuating means to said drilling means and supplying torque to said drilling means; and, d) means for applying force directly to said drilling means to enhance cutting efficiency and to extend length of reliability of flexible connecting means, said means for applying force comprising:

i) piston means for supplying the force to said drilling means;

ii) a bracket connected to said piston means for translating said force to said drilling means; and, iii) bearings positioned between and in contact with said drilling means and said bracket.

16. The drilling system of claim 15 wherein said piston comprises a base and a stem, said stem being connected to said bracket and said base being positioned inside a chamber, said piston base being in slidable contact with the walls of said chamber.

17. The drilling system of claim 16 further comprising hydraulic fluid to supply force to said piston base.

18. The drilling system of claim 15 wherein said piston means comprises a plurality of pistons.

* * * * *